US009672770B2

(12) United States Patent
Yang et al.

(10) Patent No.: US 9,672,770 B2
(45) Date of Patent: Jun. 6, 2017

(54) PIXEL CIRCUIT AND DRIVING METHOD THEREOF, DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xue Dong, Beijing (CN); Haisheng Wang, Beijing (CN); Hailin Xue, Beijing (CN); Xiaochuan Chen, Beijing (CN); Xiaoliang Ding, Beijing (CN); Yingming Liu, Beijing (CN); Weijie Zhao, Beijing (CN); Hongliang Yuan, Beijing (CN); Kaixuan Wang, Beijing (CN); Wei Li, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/800,577

(22) Filed: Jul. 15, 2015

(65) Prior Publication Data

US 2016/0232836 A1 Aug. 11, 2016

(30) Foreign Application Priority Data

Feb. 10, 2015 (CN) ..... 2015 1 0070013

(51) Int. Cl.

| | |
|---|---|
| ***G09G 3/20*** | (2006.01) |
| ***G09G 3/32*** | (2016.01) |
| ***G09G 3/3233*** | (2016.01) |

(52) U.S. Cl.

CPC ... *G09G 3/3233* (2013.01); *G09G 2300/0819* (2013.01); *G09G 2300/0861* (2013.01); *G09G 2320/043* (2013.01)

(58) Field of Classification Search

CPC ..... G09G 3/2096; G09G 3/3275; G09G 2310/061; G09G 2320/0233; G09G 2320/045

See application file for complete search history.

(56) References Cited

U.S. PATENT DOCUMENTS

2014/0320544 A1 10/2014 Kim
2014/0354517 A1 12/2014 Chung et al.
2015/0084842 A1* 3/2015 Kim ..... G09G 3/3233 345/76

FOREIGN PATENT DOCUMENTS

CN 103198793 A * 7/2013 ..... G09G 3/3233
CN 104091562 A 10/2014
CN 104157241 A 11/2014

OTHER PUBLICATIONS

Office Action in Chinese Application No. 2015100700130 dated Jul. 6, 2016, with English translation. 9 pages.

(Continued)

*Primary Examiner* — Amare Mengistu
*Assistant Examiner* — Jennifer Zubajlo
(74) *Attorney, Agent, or Firm* — Blakely Sokoloff Taylor & Zafman LLP

(57) ABSTRACT

A pixel circuit is disclosed, comprising: a driving module, an energy storage module, an electroluminescence module, a data voltage write module and a threshold compensation module, the threshold compensation module being connected with a compensation voltage input end, a first end of the energy storage module and at least one control signal input end, adapted to compensate the voltage of the first end of the energy storage module as a sum of the startup (Continued)

threshold of the driving module and the compensation voltage accessed by the compensation voltage input end in response to the control signal accessed by the connected control signal input end.

18 Claims, 10 Drawing Sheets

(56) References Cited

OTHER PUBLICATIONS

Office Action in Chinese Application No. 201510070013.0 dated Dec. 2, 2016, with English translation. 6 pages.

* cited by examiner

PIXEL CIRCUIT AND DRIVING METHOD THEREOF, DISPLAY DEVICE

RELATED APPLICATIONS

The present application claims the benefit of Chinese Patent Application No. 201510070013.0, filed on Feb. 10, 2015, the entire disclosure of which is incorporated herein by reference.

TECHNICAL FIELD

This disclosure relates to the field of display technology, particularly to a pixel circuit and a driving method thereof, and a display device.

BACKGROUND ART

The organic light emitting diode (OLED) is one of the hotspots in the panel display research field nowadays, as a current type light emitting device, it has been increasingly applied in the high performance display field due to its characteristics of self-luminous, quick response, wide visual angle and capable of being fabricated on a flexible substrate. At present, the OLED has begun to replace the conventional liquid crystal display (LCD) in the display fields of mobile phones, PDA, digital camera and the like. The pixel driving circuit design is the core technical content of the OLED display, which has important research significance. Different from the thin film transistor (TFT)-LCD which makes use of a stable voltage to control the luminance, the OLED belongs to current driving, which requires stable current to control luminescence. Due to technological process and device aging, in the original 2T1C driving circuit (including two thin film transistors and one capacitor), the threshold voltages of respective pixel points for driving the TFT are nonuniform, thus it results in variation of the current that flows through each pixel point OLED and makes the display luminance nonuniform, thereby influencing the display effect of the whole image.

SUMMARY OF THE DISCLOSURE

One object of this disclosure provides a pixel circuit, so as to avoid nonuniformity of the display luminance caused by threshold shift.

This disclosure provides a pixel circuit, comprising: a driving module, an energy storage module, an electroluminescence module, a data voltage write module and a threshold compensation module, and having a working voltage input end, a data voltage input end, a compensation voltage input end and a plurality of control signal input ends; wherein, a control end of the driving module is connected with a first end of the energy storage module, adapted to generate a driving current for driving the electroluminescence module to emit light and outputting it through a second end of the driving module when a first end of the driving module accesses the working voltage input end and the voltage of the first end of the energy storage module reaches a startup threshold of the driving module;

the data voltage write module is connected with the data voltage input end, at least one control signal input end and a second end of the energy storage module, adapted to write a data voltage accessed by the data voltage input end into the second end of the energy storage module in response to a control signal accessed by the connected control signal input end;

the threshold compensation module is connected with the compensation voltage input end, the first end of the energy storage module and at least one control signal input end, adapted to compensate a voltage of the first end of the energy storage module as a sum of the startup threshold of the driving module and a compensation voltage accessed by the compensation voltage input end in response to the control signal accessed by the connected control signal input end.

Further, the threshold compensation module comprises a first controlled switch unit and a second controlled switch unit; the first controlled switch unit is connected between the compensation voltage input end and the second end of the driving module, the second controlled switch unit is connected between the first end of the driving module and the first end of the energy storage module.

Further, a control end of the first controlled switch unit and a control end of the second controlled switch unit are connected with the same control signal input end, and correspond to a consistent startup level.

Further, the threshold compensation module further comprises a third controlled switch unit and a fourth controlled switch unit; a first end of the third controlled switch unit is coupled between the second switch unit and the first end of the driving module, a second end is connected with the working voltage input end; a first end of the fourth controlled switch unit is coupled between the first controlled switch unit and the second end of the driving module, a second end is connected with the compensation voltage input end.

Further, a control end of the third controlled switch unit and a control end of the fourth controlled switch unit are connected with the same control signal input end, and correspond to a consistent startup level.

Further, it further comprises: a reset module, the reset module being connected with the first end of the energy storage module and at least one control signal input end, reset the voltage of the first end of the energy storage module in response to the control signal accessed by the connected control signal input end.

Further, the pixel circuit further comprises a ground end;

the reset module comprises a fifth controlled switch unit, a second end of the fifth switch unit is connected with the first end of the energy storage module, a first end is connected with the ground end.

Further, it further comprises:

a reset module, the reset module is connected with the second end of the energy storage module and at least one control signal input end, adapted to reset the voltage of the second end of the energy storage module in response to the control signal accessed by the connected control signal input end.

Further, the reset module comprises a sixth controlled switch unit, a second end of the sixth controlled switch unit being connected with the second end of the energy storage module, a first end being connected to the ground end or the working voltage input end or the compensation voltage input end.

Further, a control end of the sixth controlled switch unit and the control ends of the first controlled switch unit and the second controlled switch unit are connected with the same control signal input end.

Further, the data voltage write module comprises a seventh controlled switch unit, the seventh controlled switch unit is connected between the data voltage input end and the second end of the energy storage module.

Further, the respective controlled switch units and the driving module are all P-type transistors.

This disclosure further provides a method of driving a pixel circuit as stated above, the method comprising:

a compensation stage, applying a control signal to enable the threshold compensation module to compensate the voltage of the first end of the energy storage module as a sum of the startup threshold of the driving module and the voltage accessed by the compensation voltage input end;

a data voltage write stage, applying a control signal to enable the data voltage write module to write the voltage accessed by the data voltage input end into the second end of the energy storage module.

Further, when the threshold compensation module comprises the first controlled switch unit, the second controlled switch unit, the third controlled switch unit and the fourth controlled switch unit, the step of applying a control signal to enable the threshold compensation module to compensate the voltage of the first end of the energy storage module as a sum of the startup threshold of the driving module and the voltage accessed by the compensation voltage input end comprises:

applying a control signal to enable the first controlled switch unit and the second controlled switch unit to be turned on, and enable the third controlled switch unit and the fourth controlled switch unit to be turned off.

Further, when the pixel circuit is a pixel circuit as claimed in claim 6, prior to the compensation stage, the method further comprises:

a reset stage, applying a control signal to enable the reset module to reset the voltage of the first end of the energy storage module.

This disclosure further provides a display device comprising a pixel circuit stated above.

The pixel circuit provided by this disclosure comprises a threshold compensation module, the threshold compensation module can introduce the voltage of the compensation voltage input end, and set the voltage of the control end of the driving module as the sum of the startup threshold of the driving module and the compensation voltage, thus, in the subsequent luminescence process, the startup threshold component contained in the voltage of the control end of the driving module can counteract the startup threshold of the driving module, thereby being capable of protecting the driving current that flows through the electroluminescent unit from being influenced by the startup threshold of the corresponding driving module, and solving the problem of nonuniform display luminance caused by startup threshold shift of the driving transistor thoroughly.

DETAILED DESCRIPTION OF THE DISCLOSURE

In order to make the purposes, the technical solutions and the advantages of the embodiments of this disclosure clearer, the technical solutions in the embodiments of this disclosure will be described clearly and completely in combination with the drawings in the embodiments of this disclosure, apparently, the embodiments described are only part, rather than all of the embodiments of this disclosure. All of the other embodiments obtained by the ordinary skilled person in the art based on the embodiments of this disclosure without paying any creative work belong to the protection scope of this disclosure.

Figure 1:
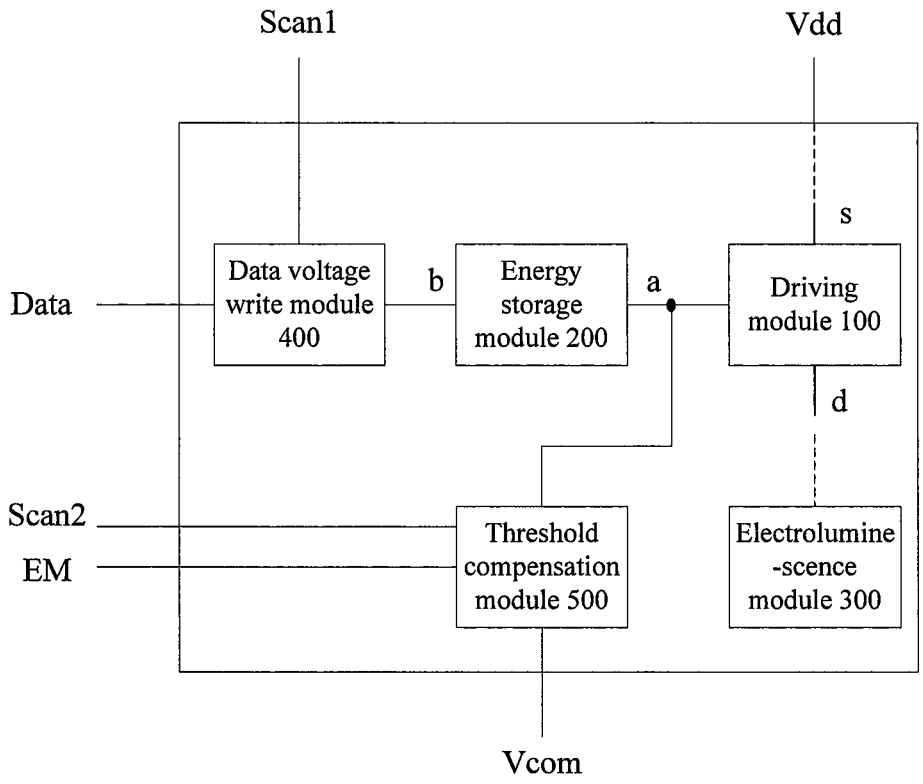
FIG. 1 is a structural schematic view of a pixel circuit provided by an embodiment of this disclosure.

An embodiment of this disclosure provides a pixel circuit, as shown in FIG. 1, the pixel circuit may comprise: a driving module 100, an energy storage module 200, an electroluminescence module 300, a data voltage write module 400 and a threshold compensation module 500, and have a working voltage input end Vdd, a data voltage input end Data, a compensation voltage input end Vcom and a plurality of control signal input ends Scan1, EM; wherein, a control end of the driving module 100 is connected with a first end of the energy storage module 200, adapted to generate a driving current for driving the electroluminescence module 300 to emit light and outputting it through a second end d of the driving module 100 when a first end s of the driving module 100 accesses the working voltage input end Vdd and the voltage of the first end a of the energy storage module 200 reaches a startup threshold Vth of the driving module 100;

the data voltage write module 400 is connected with the data voltage input end Data, the control signal input end Scanl and a second end b of the energy storage module 200, adapted to write a data voltage accessed by the data voltage input end Data into the second end b of the energy storage module 200 in response to a control signal accessed by the connected control signal input end Scan1;

the threshold compensation module 500 is connected with the compensation voltage input end Vcom, the first end a of the energy storage module 200 and the control signal input end Scan2 and EM, adapted to compensate a voltage of the first end a of the energy storage module 200 as a sum of the startup threshold Vth of the driving module 100 and a compensation voltage accessed by the compensation voltage input end Vcom in response to the control signal accessed by the connected control signal input end Scan2 and EM.

The pixel circuit provided by this disclosure comprises a threshold compensation module, the threshold compensation module can introduce the voltage of the compensation voltage input end, and set the voltage of the control end of the driving module as the sum of the startup threshold of the driving module and the compensation voltage, thus, in the subsequent luminescence process, the startup threshold component contained in the voltage of the control end of the driving module can counteract the startup threshold of the driving module, thereby being capable of protecting the driving current that flows through the electroluminescent unit from being influenced by the startup threshold of the corresponding driving module, and solving the problem of nonuniform display luminance caused by startup threshold shift of the driving transistor thoroughly.

Figure 2:
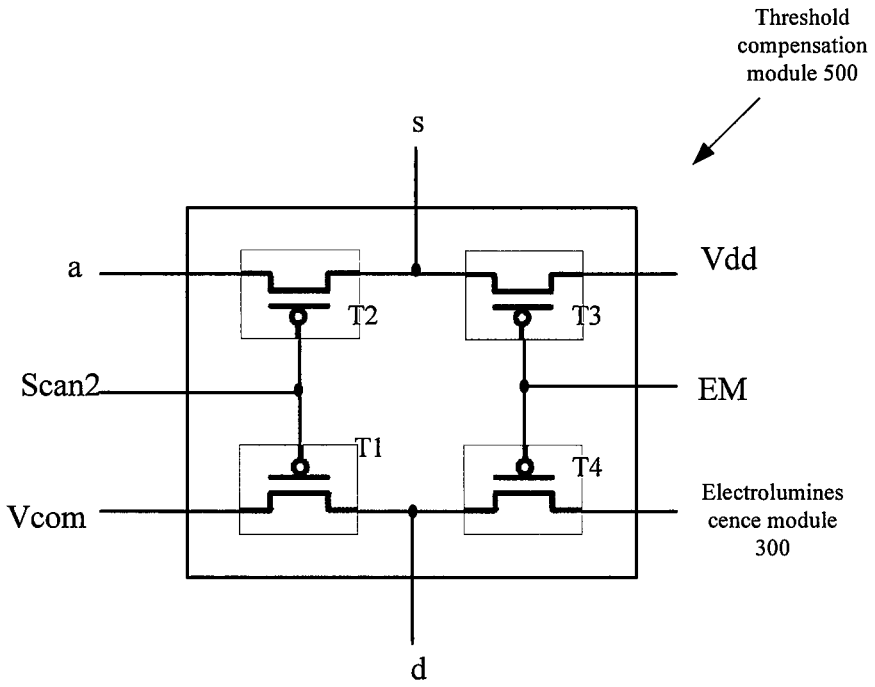
FIG. 2 is a possible circuit schematic view of threshold compensation module 500 in FIG. 1.

In specific implementation, as shown in FIG. 2, one of the structures of the threshold compensation module 500 may specifically comprise a first controlled switch unit T1 and a second controlled switch unit T2, wherein the first control switch unit T1 is connected between the compensation voltage input end Vcom and the second end d of the driving module, the second controlled switch unit T2 is connected between the first end s of the driving module 100 and the first end a of the energy storage module 200.

In specific implementation, the control end of the first controlled switch unit T1 and the control end of the second controlled switch unit T2 are connected to the first control signal input end Scan2 and correspond to a consistent startup level.

Corresponding to a consistent startup level here means that the controlled switch unit T1 and the second controlled switch unit T2 are both turned on at high level or both turned on at low level. The benefit of doing so is being capable of reducing the amount of the control signals used.

Also referring to FIG. 2, in specific implementation, the threshold compensation module 500 further comprises: a third controlled switch unit T3 and a fourth controlled switch unit T4, the first end of the third controlled switch unit T3 is coupled between the second switch unit T2 and the first end s of the driving module 100, the second end is connected with the working voltage input end Vdd; the first end of the fourth controlled switch unit T4 is coupled between the first controlled switch unit T1 and the second end d of the driving module 100, the second end is connected with the compensation voltage input end Vcom.

In specific implementation, the control end of the third controlled switch unit T3 and the control end of the fourth controlled switch unit T4 are connected with the second control signal input end EM, and correspond to a consistent startup level.

Correspondingly, corresponding to a consistent startup level here means that the controlled switch unit T3 and the fourth controlled switch unit T4 are both turned on at high level or both turned on at low level. The benefit of doing so is being capable of reducing the amount of the control signals used.

In specific implementation, the above pixel circuit can also comprise a reset module not shown in the figure, the reset module being connected with the first end of the energy storage module 200 and a third control signal input end, adapted to reset the voltage of the first end a of the energy storage module 200 in response to the control signal accessed by the third control signal input end. The reset here may refer to setting the voltage of the first end a as a preset voltage, so as to avoid the voltage of the first end a in display of the current frame from influencing display of the next frame. This voltage may be 0, and may also be other voltages.

In specific implementation, the pixel circuit here may further comprise a ground end, the reset module here may specifically comprise a fifth controlled switch unit, the second end of the fifth switch unit is connected with the first end of the energy storage module, the first end is connected with the ground end.

In actual applications indeed, the ground end here may also be replaced by other access end being capable of providing particular voltage to reset the first end a.

In specific implementation, the compensation voltage input end here may specifically access a common voltage, thus it can make the compensation voltages of all respective pixel circuits equal, which is benefit for reducing the difficulty of driving and control.

The above pixel circuit may further comprise:

a reset module, not shown in the figure, the reset module is connected with the second end b of the energy storage module 200 and a fourth control signal input end, adapted to reset the voltage of the second end b of the energy storage module 200 in response to the control signal accessed by the fourth control signal input end.

The reset module here is also for setting the voltage of the second end b of the energy storage module as a particular voltage, so as to avoid influence on the subsequent display.

The reset module comprises a sixth controlled switch unit, the second end of the sixth controlled switch unit is connected with the second end b of the energy storage module 200, the first end is connected with the ground end.

In specific implementation, the first end of the sixth switch unit here may also be connected with the compensation voltage input end Vcom or the working voltage input end Vdd, the corresponding technical solution can also achieve the technical effect of this disclosure.

In specific implementation, the data voltage write module 400 here may also comprise a seventh control switch unit specifically, the seventh controlled switch unit is connected between the data voltage input end Data and the second end b of the energy storage module 200.

In specific implementation, as shown in FIG. 1, the above driving module may specifically comprise a driving transistor DT, the source of the driving transistor DT serves as the first end s of the driving module 100, the drain serves as the second end d of the driving module 100, the gate serves as the control end of the driving module 100.

In specific implementation, the respective controlled switch units may also be transistors, here, the transistors to which the respective controlled switch units correspond and the driving transistor in the driving module can also be P-type transistors. Here the threshold voltages of respective transistors are all negative values.

In actual applications indeed, part or all of the above respective controlled switch units may also be replaced as N-type transistors. The corresponding technical solution can also solve the technical problem to be solved by this disclosure, and should also fall within the protection scope of this disclosure.

In specific implementation, the energy storage module 200 here may specifically comprise a capacitor. In actual applications indeed, other elements with the energy storage function can also be used based on design requirements.

In specific implementation, the electroluminescence module 300 may specifically comprise an organic electroluminescence element OLED, the anode of the organic electroluminescence element OLED is connected with the fourth switch unit, the cathode is connected with the ground end.

On the other aspect, this disclosure further provides a method of driving a pixel circuit, which can be used for driving a pixel circuit as stated in any of the above, the method comprising:

a compensation stage, applying a control signal to enable the threshold compensation module to compensate the voltage of the first end of the energy storage module as a sum of the startup threshold of the driving module and the voltage accessed by the compensation voltage input end;

a data voltage write stage, applying a control signal to enable the data voltage write module to write the voltage accessed by the data voltage input end into the second end of the energy storage module.

By means of the driving method provided by this disclosure, the driving current that flows through the electroluminescence unit can be protected from being influenced by the startup threshold of the corresponding driving module, and the problem of nonuniform display luminance caused by startup threshold shift of the driving module can be solved thoroughly.

Further, when the threshold compensation module in the pixel circuit comprises the first controlled switch unit, the second controlled switch unit, the third controlled switch unit and the fourth controlled switch unit, the step of applying a control signal to enable the threshold compensation module to compensate the voltage of the first end of the energy storage module as a sum of the startup threshold of the driving module and the voltage accessed by the compensation voltage input end comprises:

applying a control signal to enable the first controlled switch unit and the second controlled switch unit to be turned on, and enable the third controlled switch unit and the fourth controlled switch unit to be turned off.

When the pixel circuit further comprises a reset module, prior to the compensation stage, the method further comprises:

a reset stage, applying a control signal to enable the reset module to reset the voltage of the first end of the energy storage module.

In addition, in actual applications, after the above compensation stage, the above method further comprises a luminescence stage generally.

Figure 3:
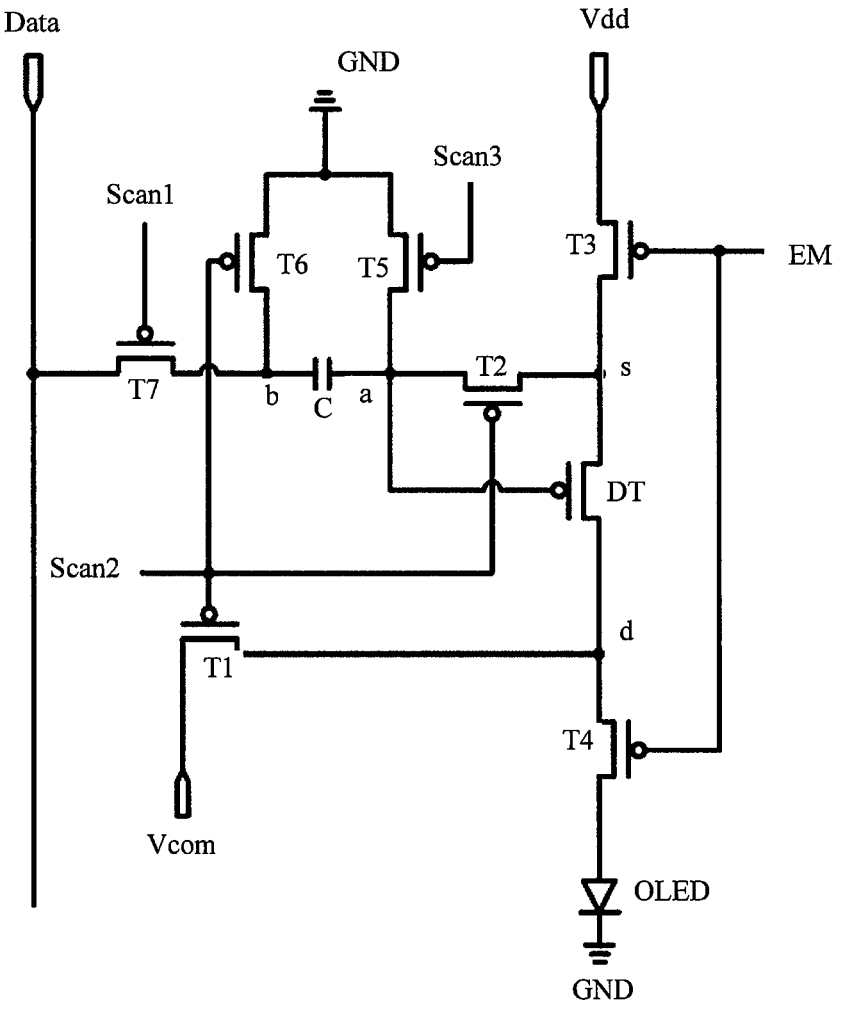
FIG. 3 is a circuit structural view of a pixel circuit provided by an embodiment of this disclosure.

Next, a specific circuit structure will be combined to explain the driving method of a pixel circuit and the working principle thereof provided in the embodiment of this disclosure, as shown in FIG. 3, it is a possible circuit schematic view of the pixel circuit, including totally seven P-type switch transistors T1-T7, a P-type driving transistor DT, an electroluminescence element OLED and a capacitor C, wherein the switch transistors T1, T2, T3, T4 constitute a threshold compensation module, the transistor T5 constitutes a reset module, the transistor T6 constitutes a reset module, the transistor T7 constitutes a data voltage write module, the capacitor C constitutes an energy storage module; the pixel circuit further has a working voltage input end Vdd, a data voltage intput end Data, a ground end GND, control signal input ends Scan1, Scan2, Scan3 and EM; wherein the gates of the switch transistors T1, T2, T6 are all connected with the control signal input end Scan2, the gates of the switch transistors T3 and T4 are connected with the control signal input end EM, the gate of the switch transistor T5 is connected with the control signal input end Scan3, the gate of the switch transistor T7 is connected with the control signal input end Scanl; the drain of the switch transistor T1, and the source of the switch transistor T4 are both connected with the drain d of the driving transistor DT, the source of the switch transistor T1 is connected with the compensation voltage input end Vcom, the drain of the switch transistor T4 is connected with the anode of the electroluminescence element OLED, the cathode of the OLED is connected to the ground end GND; the drain of the switch transistor T2, the source of the switch transistor T5, and the gate of the driving transistor DT are connected with the first end a of the capacitor C, the source of the switch transistor T2 is connected with the source s of the driving transistor DT, the drain of the switch transistor T5 is connected with the ground end GND; the drain of the switch transistor T3 is connected with the source s of the driving transistor DT, the source is connected with the working voltage input end Vdd; the source of the switch transistor T6, and the drain of the switch transistor T7 are connected with the second end b of the capacitor C, the drain of the switch transistor T6 is connected with the ground end GND, the source of the switch transistor T7 is connected with the data voltage input end Data.

Figure 4:
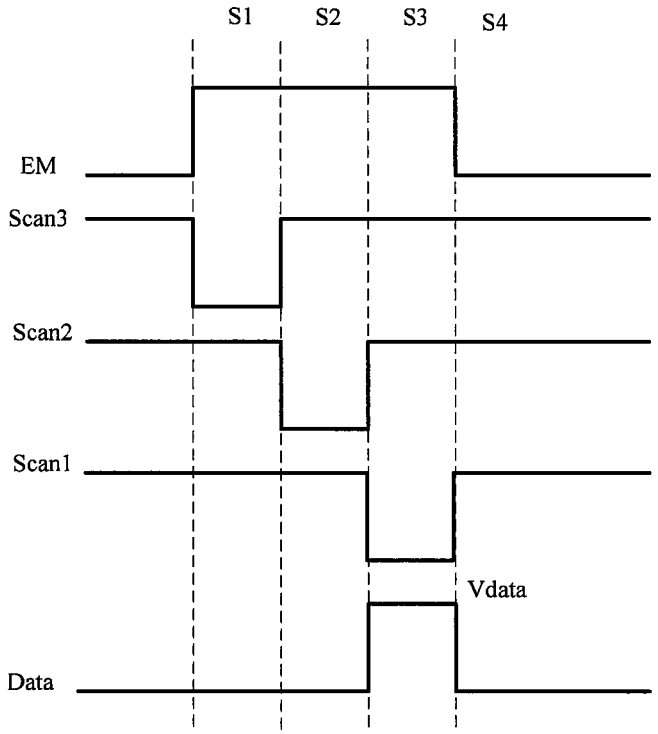
FIG. 4 is a timing diagram of key input signals in a method of driving the pixel circuit in FIG. 3.
Figure 5A:
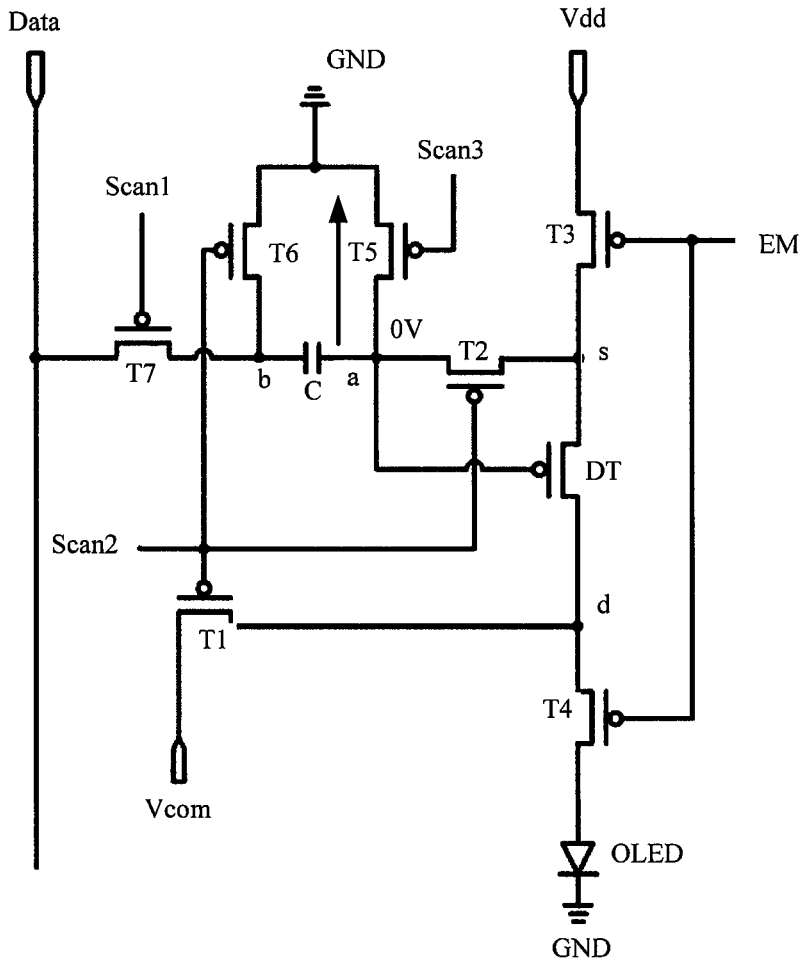
FIG. 5*a* to FIG. 5*d* are schematic views of current flow directions and key node voltage values of the pixel circuit in FIG. 3 under different time sequences.

FIG. 4 is a timing diagram of key signals in the driving method for driving the pixel circuit of FIG. 3, specifically comprising:

reset stage S1, in which low level is applied at the control signal input end Scan3, so as to turn on the switch transistor T5, and high level is applied at other respective control signal input ends, so as to turn off other switch transistors except for the transistor T5. Here, as shown in FIG. 5*a*, the first end a of the capacitor C is connected with the ground end GND, the charges stored therein flow to the ground end via the switch transistor T5, the level at the end a is reset as 0, the switch transistor T5 plays the function of resetting the voltage of the end a.

Figure 5B:
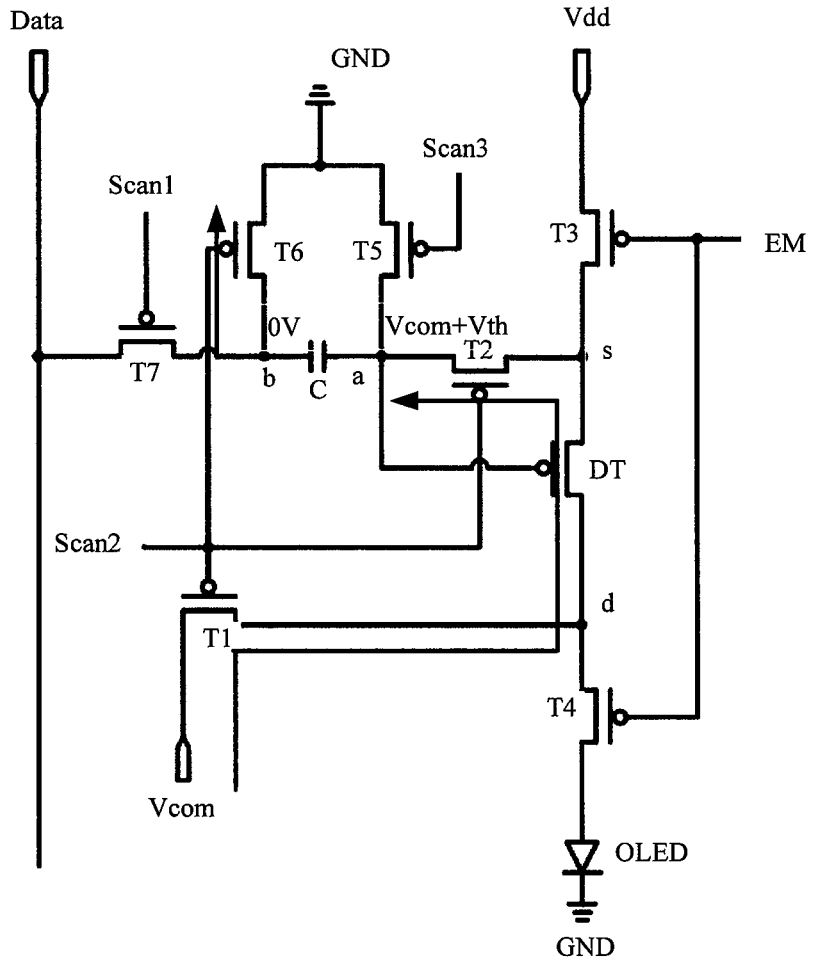

Compensation stage S2, in which low level is applied at the control signal input end Scan2, and high level is applied at all other control signal input ends, so as to turn on the switch transistors T1, T2 and T6, and turn off other switch transistors. Here, the drain of the driving transistor DT is conducted with the compensation voltage input end Vcom, the source of the driving transistor DT is conducted with the end a of the capacitor C. As shown in FIG. 5*b*, the compensation voltage input end Vcom charges the end a of the capacitor C via the switch transistor T1, the driving transistor DT, and the switch transistor T2, until the voltage of the end a reaches Vcom+Vth (here the cut-off condition of the driving transistor DT is reached, the Vth here is the startup threshold of the driving transistor DT, which is a negative value here). At the stage, since the switch transistors T3 and T4 are turned off, threshold compensation to the end a can be performed successfully. Moreover, since the switch transistor T4 is turned off, the electroluminescence element OLED here will not emit light, which prolongs the use lifetime of the electroluminescence element OLED. In addition, since the switch transistor T6 is turned on, such that the voltage of the end b of the capacitor C is consistent with the ground end, both are 0. The voltage difference between the two ends a and b of the capacitor C here is Vcom+Vth. The switch transistors T1, T2, T3 and T4 together realize threshold compensation to the end a of the capacitor C. The switch transistor T6 plays the function of resetting the end b of the capacitor C.

Figure 5C:
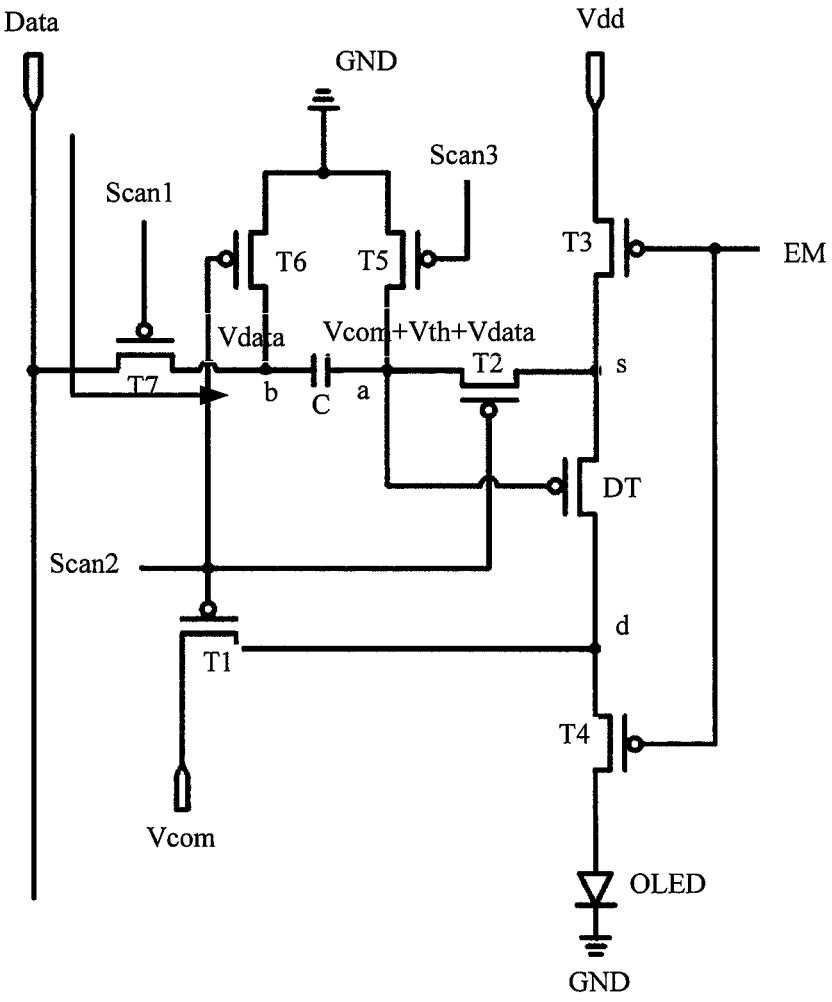

Data voltage write stage S3, in which low level is applied at the control signal input end Scan1, and high level is applied at other control signal input ends, here the data voltage required by the current luminescence is applied on the data voltage input end Data. Here only the switch transistor T7 is turned on, other switch transistors are all turned off. As shown in FIG. 5*c*, the data voltage input end Data is connected with the end b of the capacitor C via the switch transistor T3, charges the end b of the capacitor via the switch transistor T4, and writes the data voltage Vdata into the end b of the capacitor C. Here, in order to keep the original voltage difference Vcom+Vth, voltage jump occurs at the end a of the capacitor C, the voltage jump is Vcom+Vth+Vdata.

Figure 5D:
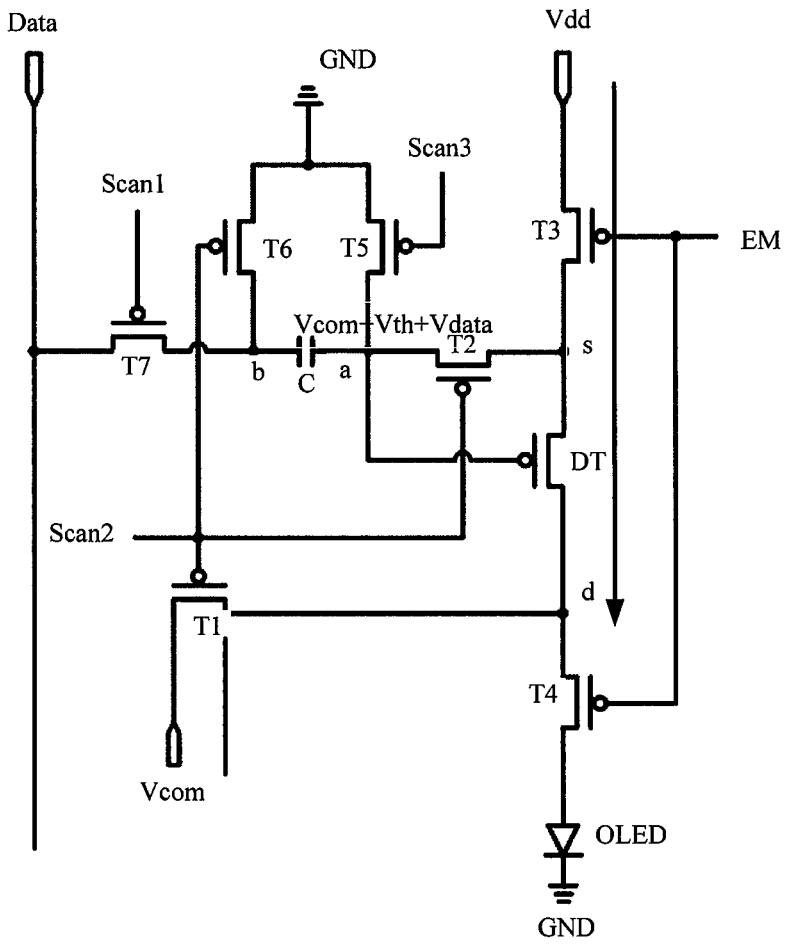

Luminescence stage S4, low level is applied at the control signal input end EM, and high level is applied at other control signal input ends, here the switch transistors T3 and T4 are turned on, other switch transistors are all turned off. As shown in FIG. 5*d*, the working voltage access end Vdd accesses the source of the driving transistor DT, the driving transistor DT generates a current for driving the electroluminescence element OLED which flows to the electroluminescence element OLED through the switch transistor T4, so as to enable the electroluminescence element OLED to emit light. Since the gate voltage of the driving transistor DT is Vcom+Vth+Vdata, it can be obtained from the TFT saturation current formula:

$$\begin{aligned} I_{OLED} &= K(VGS - Vth)^2 \\ &= K[(Vcom + Vth + Vdata) - Vdd - Vth]^2 \\ &= K(Vcom + Vdata - Vdd)^2 \end{aligned}$$

From the above formula it can be seen that the working current $I_{OLED}$ here is not influenced by the startup threshold of the driving transistor, but only related with the data voltage Vdata. The problem of startup threshold Vth shift of the driving transistor DT caused by technological process and long time operation is solved thoroughly, the influence on $I_{OLED}$ is eliminated, and normal operation of the electroluminescence element OLED is ensured.

Figure 6:
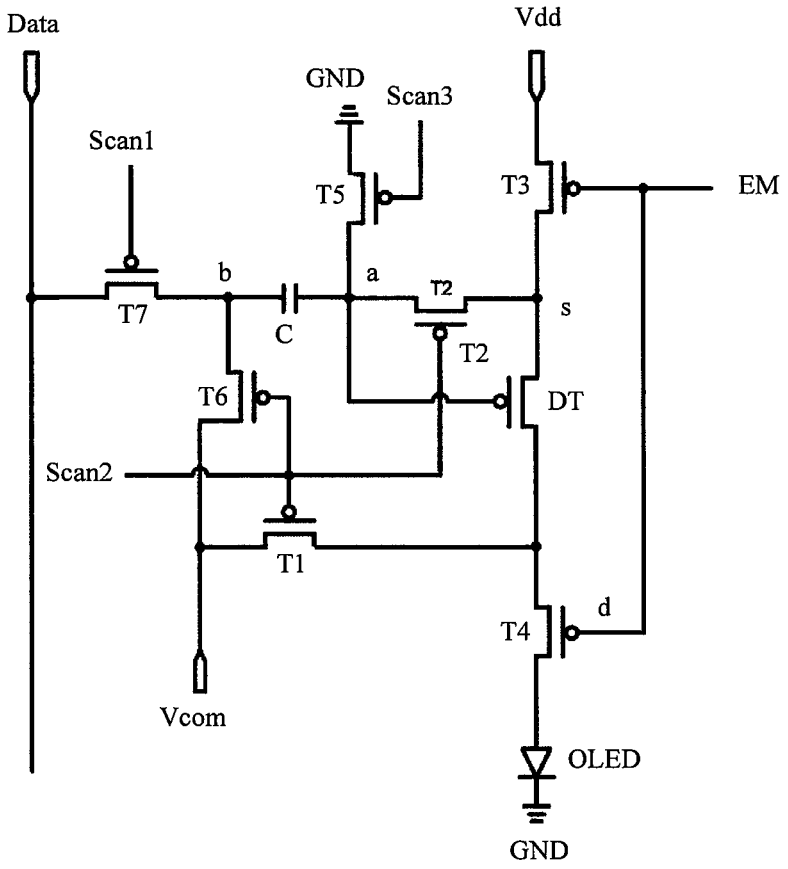
FIG. 6 is a circuit structural view of a pixel circuit provided by a further embodiment of this disclosure.
Figure 7:
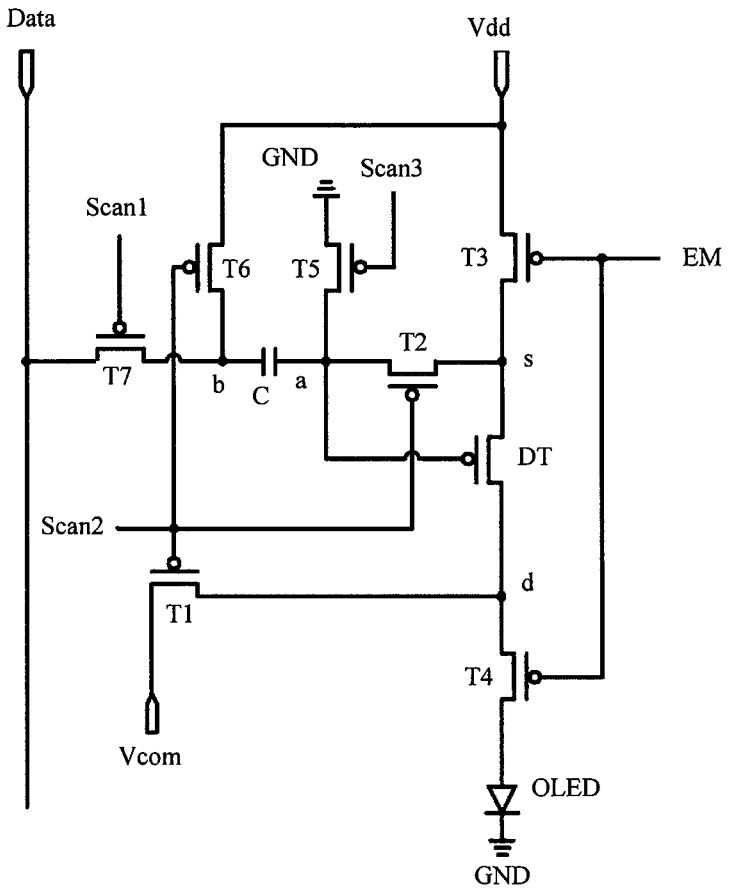
FIG. 7 is a circuit structural view of a pixel circuit provided by a further embodiment of this disclosure.

In actual applications, the drain of the switch transistor T6 which serves as the reset module may also be connected with the compensation voltage input end Vcom as shown in FIG. 6, or connected with the working voltage input end Vdd as shown in FIG. 7. Here, the above driving method may also be used for driving;

What differs is, for the pixel circuit as shown in FIG. 6, after the compensation stage S2, the voltage of the end b of the capacitor is Vcom, the voltage difference between the two ends of the capacitor C is Vcom+Vth−Vcom, after the data voltage write stage S3, the voltage of the end a of the capacitor C is Vth+Vdata, finally, at the luminescence stage S4, it is obtained $$\begin{aligned} I_{OLED} &= K(VGS - Vth)^2 \\ &= K(Vth + Vdata - Vdd - Vth)^2 \\ &= K(Vdata - Vdd)^2 \end{aligned}$$

For the pixel circuit as shown in FIG. 7, after the compensation stage S2, the voltage of the end b of the capacitor is Vcom, the voltage difference between the two ends of the capacitor C is Vcom+Vth−Vdd, after the data voltage write stage S3, the voltage of the end a of the capacitor C is Vcom+Vth−Vdd+Vdata, finally, at the luminescence stage S4, it is obtained $$\begin{aligned} I_{OLED} &= K(VGS - Vth)^2 \\ &= K(Vcom + Vth - Vdd + Vdata - Vdd - Vth)^2 \\ &= K(Vcom + Vdata - 2Vdd)^2 \end{aligned}$$

It can be seen that based on the pixel circuit and the corresponding driving method provided in FIG. 6 and FIG. 7 provided by this disclosure, the working current $I_{OLED}$ is neither influenced by the startup threshold Vth of the driving transistor, but only related with the data voltage Vdata. The problem of startup threshold Vth shift of the driving transistor DT caused by technological process and long time operation is solved thoroughly, the influence on $I_{OLED}$ is eliminated, and normal operation of the electroluminescence element OLED is ensured.

In actual applications, the above switch transistor T6 which serves as the reset module is actually not a structure that must be arranged, in actual applications, in the case of not arranging the switch transistor T6, a first data voltage Vdata' can be applied at the data voltage input end Data firstly at the threshold compensation stage, and a control signal is applied to turn on the switch transistor T7, after the threshold compensation, the voltage different between the two ends a and b of the capacitor C is Vcom+Vth−Vdata', and then, at the data voltage write stage, continue to turn on the switch transistor T7, a second data voltage Vdata is applied at the data voltage input end, thus the voltage jump at the end a is Vcom+Vth−Vdata'+Vdata, by setting appropriate Vdata' and Vdata, correct driving of the electroluminescence element OLED can also be achieved, based on the above TFT saturation current formula, the luminescence of the electroluminescence element OLED here is also unrelated with the threshold Vth of the driving transistor DT.

This disclosure further provides a display device comprising a pixel circuit as stated in any of the above.

The display device here may be any product or component with the display function such as electronic paper, mobile phone, tablet computer, television, display, laptop, digital photo frame, navigator etc.

What are stated above are only specific implementing modes of this disclosure, however, the protection scope of this disclosure is not limited to this, any modifications or replacements that the skilled person familiar with the present technical field can easily think of within the technical scope disclosed by this disclosure should be covered within the protection scope of this disclosure. Therefore, the protection scope of this disclosure should be based on the protection scopes of the claims.

The invention claimed is:

1. A pixel circuit, comprising: a driving module, an energy storage module, an electroluminescence module, a data voltage write module and a threshold compensation module, and having a working voltage input end, a data voltage input end, a compensation voltage input end and a plurality of control signal input ends; wherein the threshold compensation module is connected with the compensation voltage input end, a first end of the energy storage module and at least one control signal input end, and is adapted to compensate a voltage of the first end of the energy storage module as a sum of a startup threshold of the driving module and a compensation voltage accessed by the compensation voltage input end in response to a control signal accessed by the connected control signal input end;

the data voltage write module is connected with the data voltage input end, at least one control signal input end and a second end of the energy storage module, and is adapted to write a data voltage accessed by the data voltage input end into the second end of the energy storage module in response to a control signal accessed by the connected control signal input end; and the driving module has a control end connected with the first end of the energy storage module, and is adapted to, in response to the voltage of the first end of the energy storage module when a first end of the driving module accesses the working voltage input end, generate and output through a second end of the driving module a driving current for driving the electroluminescence module to emit light, wherein the threshold compensation module comprises a first controlled switch unit and a second controlled switch unit, wherein the first controlled switch unit is connected between the compensation voltage input end and the second end of the driving module, and the second controlled switch unit is connected between the first end of the driving module and the first end of the energy storage module.

2. The pixel circuit as claimed in claim 1, wherein a control end of the first controlled switch unit and a control end of the second controlled switch unit are connected with the same control signal input end, and correspond to a consistent startup level.

3. The pixel circuit as claimed in claim 2, wherein the threshold compensation module further comprises a third controlled switch unit and a fourth controlled switch unit, wherein a first end of the third controlled switch unit is coupled between the second controlled switch unit and the first end of the driving module, a second end of the third controlled switch unit is connected with the working voltage input end, a first end of the fourth controlled switch unit is coupled between the first controlled switch unit and the second end of the driving module, and a second end of the fourth controlled switch unit is connected with the compensation voltage input end.

4. The pixel circuit as claimed in claim 3, wherein a control end of the third controlled switch unit and a control end of the fourth controlled switch unit are connected with the same control signal input end, and correspond to a consistent startup level.

5. The pixel circuit as claimed in claim 4, further comprising: a first reset module connected with the first end of the energy storage module and at least one control signal input end, and adapted to reset the voltage of the first end of the energy storage module in response to a control signal accessed by the connected control signal input end.

6. The pixel circuit as claimed in claim 5, wherein the pixel circuit further comprises a ground end; and wherein the first reset module comprises a fifth controlled switch unit, a second end of the fifth controlled switch unit being connected with the first end of the energy storage module, a first end of the fifth switch unit being connected with the ground end.

7. The pixel circuit as claimed in claim 6, further comprising:

a second reset module connected with the second end of the energy storage module and at least one control signal input end, and adapted to reset a voltage of the second end of the energy storage module in response to the control signal accessed by the connected control signal input end.

8. The pixel circuit as claimed in claim 7, wherein the second reset module comprises a sixth controlled switch unit, a second end of the sixth controlled switch unit being connected with the second end of the energy storage module, a first end of the sixth controlled switch unit being connected to the ground end or the working voltage input end or the compensation voltage input end.

9. The pixel circuit as claimed in claim 8, wherein a control end of the sixth controlled switch unit and the control ends of the first controlled switch unit and the second controlled switch unit are connected with the same control signal input end.

10. The pixel circuit as claimed in claim 9, wherein the data voltage write module comprises a seventh controlled switch unit connected between the data voltage input end and the second end of the energy storage module.

11. The pixel circuit as claimed in claim 10, wherein the respective controlled switch units and the driving module are all P-type transistors.

12. A method of driving a pixel circuit as claimed in claim 1, comprising:

in a compensation stage, compensating, by the threshold compensation module, the voltage of the first end of the energy storage module as a sum of the startup threshold of the driving module and the voltage accessed by the compensation voltage input end; and in a data voltage write stage, writing, by the data voltage write module, the voltage accessed by the data voltage input end into the second end of the energy storage module.

13. A method of driving a pixel circuit as claimed in claim 2, comprising:

in a compensation stage, compensating, by the threshold compensation module, the voltage of the first end of the energy storage module as a sum of the startup threshold of the driving module and the voltage accessed by the compensation voltage input end; and in a data voltage write stage, writing, by the data voltage write module, the voltage accessed by the data voltage input end into the second end of the energy storage module.

14. A method of driving a pixel circuit as claimed in claim 3, comprising:

in a compensation stage, compensating, by the threshold compensation module, the voltage of the first end of the energy storage module as a sum of the startup threshold of the driving module and the voltage accessed by the compensation voltage input end; and in a data voltage write stage, writing, by the data voltage write module, the voltage accessed by the data voltage input end into the second end of the energy storage module.

15. A method of driving a pixel circuit as claimed in claim 4, comprising:

in a compensation stage, compensating, by the threshold compensation module, the voltage of the first end of the energy storage module as a sum of the startup threshold of the driving module and the voltage accessed by the compensation voltage input end; and in a data voltage write stage, writing, by the data voltage write module, the voltage accessed by the data voltage input end into the second end of the energy storage module.

16. The method as claimed in claim 14, wherein the step of compensating the voltage of the first end of the energy storage module as a sum of the startup threshold of the driving module and the voltage accessed by the compensation voltage input end comprises:

turning on the first controlled switch unit and the second controlled switch unit, and turning off the third controlled switch unit and the fourth controlled switch unit.

17. The method as claimed in claim 12, further comprising prior to the compensation stage:

in a reset stage, resetting the voltage of the first end of the energy storage module.

18. A display device, comprising the pixel circuit as claimed in claim 1.

* * * * *